United States Patent [19]

Jackson

[11] 3,962,798

[45] June 15, 1976

[54] PROCESS FOR DRYING POROUS MATERIALS

[75] Inventor: Harold L. Jackson, Hockessin, Del.

[73] Assignee: E. I. Du Pont de Nemours and Company, Wilmington, Del.

[22] Filed: May 28, 1975

[21] Appl. No.: 581,563

[52] U.S. Cl. ..... 34/9

[51] Int. Cl.[2] ..... F26B 3/00; F26B 5/00

[58] Field of Search ..... 34/9, 72

[56] References Cited

UNITED STATES PATENTS

| | | | |
|---|---|---|---|
| 3,791,044 | 2/1974 | Busker et al. | 34/9 |
| 3,903,012 | 9/1975 | Brandreth | 34/9 |

*Primary Examiner*—John J. Camby

[57] ABSTRACT

Process, suitable for drying water-wet porous materials, for example, textiles, which comprises forcing a displacement liquid through the open interstices of the water-wet porous material to remove the water, the displacement liquid consisting of a water-immiscible, normally liquid organic solvent having a surface-active agent dissolved therein, said displacement liquid having at 25°C. an interfacial tension versus water of no greater than about 10 dynes cm.$^{-1}$ at 25°C., a density of at least about 1.25 grams cm.$^{-3}$ and an advancing adhesion tension versus platinum which is positive, and recovering porous material whose open interstices are substantially free of liquid water.

24 Claims, 2 Drawing Figures

PROCESS FOR DRYING POROUS MATERIALS

BACKGROUND OF THE INVENTION

1. Field of the Invention

This invention relates to the drying of water-wet porous materials.

2. Description of the Prior Art

Conventional methods of drying water-wet porous materials by evaporation of the water consume large amounts of energy because of the high specific heat and latent heat of vaporization of water. Water-wet nonporous or nonabsorbent materials may be dried, at a lower energy investment, by displacing the water from the surfaces of the materials by means of water-immiscible organic displacement liquids. U.S. Pat. No. 3,397,150 discloses such a process for displacing water from nonabsorbent surfaces by means of spraying or dipping techniques. The displacement liquid consists of a 1,1,2-trichloro-1,2,2-trifluoroethane solution of an alkyl phosphate neutralized with an alkylamine. U.S. Pat. No. 3,386,181 discloses a continuous process for displacing water from nonabsorbent surfaces using, for example, the dislacement liquids of U.S. Pat. No. 3,397,150. Belgian Pat. No. 810,949 discloses a water displacement liquid composition comprising (a) a fluorine-containing compound having a solubility parameter of less than about 8, a density of at least about 1.3g./cc. at room temperature and a boiling point above about 20°C. and (b) a surfactant dissolved in (a) to the extent of about 0.01–5% by weight of the composition, the composition characterized by an interfacial tension with water of up to about 6 dynes/cm. and a water solubilization index of less than about 750 ppm. U.S. Pat. No. 3,003,247 discloses a process for displacing water from nonabsorbent surfaces of articles such as glass wool, woven glass fabrics and nylon and polyester filaments by means of displacement liquids consisting of chlorinated hydrocarbon solutions of cationic surface-active agents.

SUMMARY OF THE INVENTION

There is provided by this invention a process for displacing water from porous materials having open interstices. Such materials include fibrous masses, particulate masses and open-celled materials. The process is characterized by a forced flow of a displacement liquid through the interstices, resulting in the displacement of water therefrom, the displacement liquid consisting of a water-immiscible, normally liquid organic solvent having a surface-active agent dissolved therein, the displacement liquid having at 25°C. an interfacial tension versus water of up to about 10 dynes $cm.^{-1}$, a density of at least about 1.25 grams $cm^{-3}$ and an advancing adhesion tension versus platinum which is positive.

DETAILED DESCRIPTION OF THE INVENTION

Figure 1:
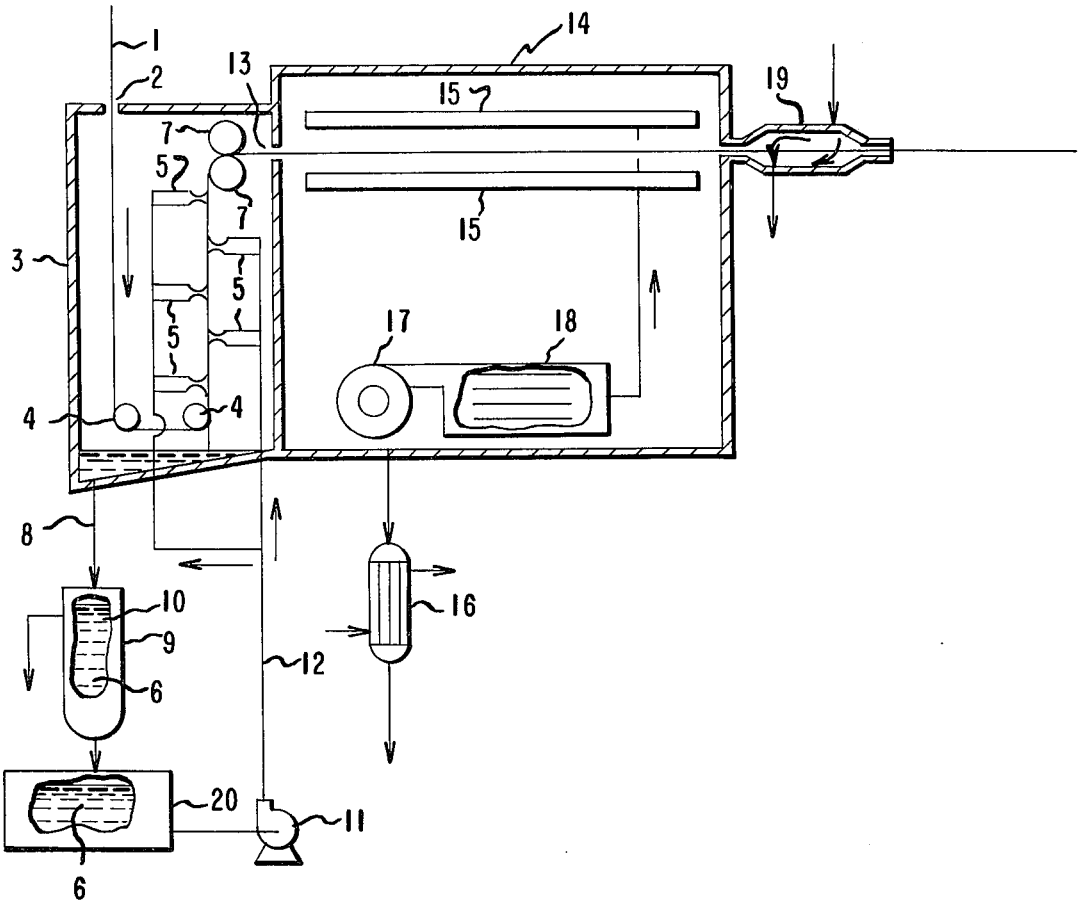
FIG. 1 illustrates a continuous process embodiment for displacing water from a moving band, such as a textile web.

The process of this invention provides a means of drying water-wet porous materials with a low energy investment. By water-wet is meant that the material has on its surfaces liquid water to an extent of at least about 10% by volume of the dry material. The process does not remove water of crystallization or compounded water, for example, chemically eliminated water, such as from an alcohol to provide an olefin or an ether. The process can be used to remove water from porous materials having open interstices. Such materials include fibrous masses, particulate masses and open-celled materials. Open interstices are interstices which are substantially free of barriers which can prevent the forced flow of displacement liquid through the material. As used herein, the term porous is employed to describe materials which are capable of retaining water within open interstices. By means of the present invention substantially all of the surface water (adsorbed water) is removed from the material. The residual water content of materials so dried is approximately the amount of moisture which the material absorbs (absorption value) when it is in equilibrium with air at 100% relative humidity. Absorption values (obtained by extrapolation from data obtained at lower humidities) for a number of common textile fibers are shown in Table 1.

Table 1

| | Wt. % $H_2O$ |
|---|---|
| polyester (polyethylene terephthalate) | 0.75 |
| polyacrylonitrile | 8.9 |
| nylon 66 | 9.0 |
| cotton | at least 28.5 |

By means of the process of this invention, water-wet substrates can be reduced in water content to a degree acceptable in the trade. As applied, for example, to the textile industry, the invention process provides a means for drying textiles batchwise or continuously with a net saving in energy and time as compared to conventional drying methods for such materials. By textile is meant fiber, yarn, fabric, carpet, nonwoven fibrous material and garment.

Water is displaced from the porous material by forcible passage of the displacement liquid, as hereinafter described, through the material. The treated material may be dried further, that is, to below its absorption value, by evaporative means, preferably by passing superheated vapor of the solvent of the displacement liquid through the material. Optionally, the material may be rinsed with the solvent of the displacement liquid following displacement of the water but prior to the aforesaid further drying. Forcible passage of displacement liquid is effected by any suitable means which results in a positive directional flow of the displacement liquid through the porous material; the process can be carried out either continuously or noncontinuously. In a non-continuous process, for example, in displacing water from the interstices of yarn packages, textile tow, nonwoven fabrics, carpeting, mats, open-celled cellular materials, powders, flakes or granules, such means include pumping devices, the use of gravity flow, pressurizing the storage vessel and application of hydraulic pressure. Forcible passage of displacement liquid in continuous processes, for example, involving the displacement of water from carpeting, textile fabric, foamed plastic or a suitably supported particulate material, can be achieved by similar means. Generally, pumping, for example, by means of a liquid jet spray or by applying reduced pressure to the side of a material which is opposite the side in contact with displacement liquid, is employed. Application of the displacement liquid as a fog or atomized spray generally is unsatisfactory, as is immersing the porous material in stirred or ebullient displacement liquid. The volume of displacement liquid which must forcibly be passed through the interstices of the porous material, that is, the volume of liquid flow required, is at least equal to the actual void volume of interstices in the material. Flow of two to three times the void volume is usually preferred. Higher flow volumes may be used and may remove additional water, but usually flow of two to three times the void volume removes substantially all of the water which can be removed under the conditions used. High rates of flow favor water displacement. That is, the higher the rate that the displacement liquid is forcibly passed through the interstices of the water-wet material, the greater is the amount of water (up to the limiting amount as discussed hereinbefore) removed. The maximum or minimum displacement liquid flow rate usually is determined by how free of water the specific material must be, the latter being determined by the use to which the material is to be put. The properties of the porous material and the displacement liquid can each affect the flow rate required to achieve a specific level of residual water in the porous material by over an order of magnitude. Properties of the porous material that must be considered include its bulk geometry, thickness, pore size, shape, surface composition, texture and contamination. Following is an illustration of the techniques involved in determining operable displacement liquid flow rates for a hollow-centered, cylindrical yarn package. The flow rate is defined in terms of the cross sectional area of he porous material. This may be referred to as the flux, which is the volume of flow (in cm.$^3$) per cross sectional area (in cm.$^2$) per unit of time (in seconds). This also can be written as cm.$^3$(cm.$^2$sec.)$^{-1}$ or cm.(sec.)$^{-1}$. For the aforesaid yarn package wherein the flow is radial, the cross sectional area is the logarithmetric mean area, $2\pi r_m l$, wherein $r_m$ is $$\frac{r_2 - r_1}{\ln(r_2/r_1)}$$

and $r_1$ and $r_2$ are, respectively, the inner and outer radii of the package and l is the length of the package (all in cm.); the yarn cross sectional area is assumed to be zero. It has been determined that, generally, a flux of at least about 0.1 cm.sec.$^{-1}$, preferably, at least about 1 cm.sec.$^{-1}$, removes the desired amount of water. It is further desirable that the ultimate flux be reached in the shortest time. Hence, the acceleration of flow or rate of flux increase should be as high as possible within the confines of the porous material. Methods for achieving the necessary flux and the desired flux acceleration are well known. For example, valving means can be employed in such a way that displacement liquid is circulated through a first loop comprising a pump and a pipeline and then suddenly diverted to a second loop comprising the porous material. This mode of operation is referred to herein as "impulsive". The term "pulsewise" is used herein to describe a mode of operation, frequently preferred, wherein multiple pulses are employed. In treating moving bands of material, such as textile webs, pulsewise, forcible flow of the displacement liquid can be achieved by passing the band in front of a plurality of fixed jets. Alternatively, displacement liquid can be sucked through the interstices, for example, in an embodiment wherein the band is submerged in displacement liquid and suction means provide the forcible flow of liquid through the material.

The above processes can be applied, employing obvious modification, to the displacement of water from open-celled cellular material. The term "open-celled" is used herein to indicate that the cells are interconnected. Examples of such cellular materials include open-celled polyurethane foams. The invention process also is useful for displacing water from fibrous material which is combined with cellular material, for example, carpet material which is combined with open-celled foam backing. The method selected for displacing water from particulate matter will depend on factors such as density and size of the particle. For example, powdered iron ore on a foraminous conveyer can be dried by passing it under jets of displacement liquid.

For reasons of economy, it generally is necessary to recover the displacement liquid for reuse. Since the displacement liquid must be water-immiscible, that is, have a solubility in water at 25°C. of no more than 0.5 weight %, preferably no more than 0.05 weight %, after contacting the water-wet material, it will comprise the lower layer of a two-phase mixture with the water. Separation of the water and the displacement liquid can readily be effected, for example, by decantation. Preferably, in both batch and continuous processes, the displacement liquid and the water should separate rapidly. The rate at which separation occurs depends, to an important degree, on the difference between the density of water and the density of the displacement liquid. When the difference is less than about 0.25, separation is sometimes too slow. Hence, the density of the displacement liquid should be at least about 1.25 grams cm.$^{-3}$ at 25°C.

The displacement liquids employed in the process of the invention comprise an organic solvent having a surface-active agent dissolved therein. In addition to having a density of at least about 1.25 grams cm.$^{-3}$, the liquid must have an interfacial tension versus water of not more than about 10 dynes cm.$^{-1}$ at 25°C. and an advancing adhesion tension versus platinum which is positive. Preferably, the interfacial tension should be not more than about 3 dynes cm.$^{-1}$. Interfacial tension is a well-known characteristic which reflect the contractile tendency of a pair of immiscible liquids. More specifically, interfacial tension is a measure of the tendency of such liquids to reduce their interfacial area. The greater the interfacial tension, the greater is the tendency to reduce the interfacial area; the lower the interfacial tension, the lower is the tendency to reduce the interfacial area and the more readily one phase disperses in the other in the form of droplets. Interfacial tension values, as disclosed herein, are based on determinations by the Wilhelmy plate method. The method employed was substantially the same as that described by Heerties et al. in Chemical Engineering Science, Vol. 26, 1479 (1971) except that a bright platinum plate was used instead of a blackened plate. Adhesion tension is the product of the interfacial tension and the cosine of the contact angle formed at the boundary of the displacement liquid, water and the platinum substrate, the angle being measured through the displacement liquid. The displacement liquids employed herein have a positive advancing adhesion tension in the system: displacement liquid, water and a platinum substrate. It is not necessary in selecting useful displacement liquids to actually measure the contact angle. It need only be known that the advancing adhesion tension is positive. The adhesion tension is positive if the displacement liquid meniscus rises into the water as the Wilhelmy plate is lowered through the water-displacement liquid interface.

The solvent of the displacement liquid primarily determines the water immiscibility and density of the liquid. In other words, the surface-active agent has little effect on these properties. Solvents which are suitable herein must have a density of at least about 1.25 grams cm.$^{-3}$ at 25°C. and they must be immiscible with water. Since the solvent of the displacement liquid must be removed from the substrate, for example, by evaporation, and generally is recovered, it is preferred that the boiling point of the solvent be high enough to permit condensation of its vapors by water-cooled condensers.

ro-tert.-amines. Fluorine-containing compounds are preferred because of their nonflammability and their greater inertness to and insolubility in polymers and fiber materials, their low toxicity, boiling point, specific heat and latent heat of vaporization and their rapid and efficient separability from water. Of the fluorine-containing compounds, the chlorofluorocarbons are preferred, with trichlorofluoromethane and 1,1,2-trichloro-1,2,2-trifluoroethane being most preferred. Of the fluorocarbons, perfluorodimethylcyclobutane is preferred. The chlorocarbons, although operable, in some uses have serious disadvantages. They may dissolve in certain polymersubstrates and they may attack certain substrates more so than the fluorocarbons and the chlorofluorocarbons. For example, depending on the temperature, up to 10 weight % of tetrachloroethylene can dissolve in polyethylene terephthalate. The chlorocarbons are also generally more toxic and less stable than are the fluorocarbons and the chlorofluorocarbons. Table 2 includes solvents which are suitable herein.

Table 2

| Solvent | Density (g. cm.$^{-3}$ at 25°C.) | Latent Heat at pp. in cal./g. | Boiling Point (°C.) |
|---|---|---|---|
| $CCl_4$ | 1.59 | 47 | 77 |
| $CCl_3CH_3$ | 1.34 | 55* | 74 |
| $CCl_2=CHCl$ | 1.46 | 57 | 87 |
| $CCl_2=CCl_2$ | 1.62 | 50 | 121 |
| $C_7F_{16}$ isomers | 1.75 | 21* | 80–88 |
| $CF_2-CF-CF_3$ \| \| $CF_2-CF-CF_3$ and isomer | 1.67 | 22* | 45 |
| $CF_2-CF_2$ O $N-C_3F_7$ $CF_2-CF_2$ and isomers | 1.78 | 20* | 90–107 |
| $CCl_3F$ | 1.49 | 44 | 24 |
| $CCl_2FCClF_2$ | 1.57 | 35 | 48 |
| $CCl_2FCCl_2F$ | 1.64 | 37 | 93 |
| $CHF_2CH_2Cl$ | 1.31 | 64* | 35 |
| $CHClFCHClF$ | — | 52* | 59 |
| $CHF_2CHCl_2$ | 1.49 | 52* | 60 |
| $CH_3ClCF_2Cl$ | 1.42 | 50* | 47 |
| $CCl_2FCH_2F$ | — | 50* | 48 |
| $CHCl_2CF_3$ | 1.48 | 41* | 29 |
| $CHClFCF_2Cl$ | 1.50 | 41* | 28 |
| $CHF_2CCl_2F$ | — | 42* | 30 |
| $CF_3CCl_2CF_3$ | 1.59 | 30* | 33 |
| $CF_3CClFCClF_2$ | 1.59 | 29* | 35 |
| $CF_2CF_2CCl$ | 1.64 | 30 | 74 |
| $CF_2ClCF_2CCl_3$ | 1.69 | 32 | 114 |
| $CF_3CFClCFClCF_3$ | 1.68 | 26* | 63 |
| $CF_3CF_2CCl_2CF_3$ | — | 26* | 64 |
| $CF_3CF_2CF_2OCFHCF_3$ | 1.54 | 23 | 41 |
| $F[CF(CF_3)CF_2O]_2CFHCF_3$ | 1.66 | 17 | 104 |

*Calculated by Trouton's Rule: $\Delta H/T = 21$ wherein $\Delta H$ is the heat of vaporization of a gram-mole and T is the absolute boiling temperature at 1 atmospheric pressure.

Preferably, therefore, the atmospheric pressure boiling point of the solvent should be at least about 20°C. Furthermore, to minimize energy consumption, the solvent should have a normal boiling point not greater than about 150°C., preferably not greater than about 50°C. Also, for energy conservation, the solvent should possess a latent heat of vaporization at its boiling temperature of below about 100 cal./gram, preferably below about 50 cal./gram. Suitable organic solvents meeting the above criteria are generally found among the chlorocarbons and fluorine-containing compounds. The fluorine-containing compounds include fluorocarbons and chlorofluorocarbons. Operable fluorine-containing compounds include fluoro and chlorofluoro substituted aliphatic and cycloaliphatic hydrocarbons and aliphatic and cycloaliphatic fluoroethers and fluo- The properties of the displacement liquid also depend on the nature and concentration of the surface-active agent dissolved therein. The surface-active agent, which may be anionic, cationic, nonionic or ampholytic, is selected, as is the concentration thereof, so that the displacement liquid has an interfacial tension versus water of not more than about 10 dynes cm.$^{-1}$ at 25°C. and a positive advancing adhesion tension versus platinum. As the concentration of surface-active agent is increased, the interfacial tension is decreased. The structure of the surface-active agent is important only to the extent that the structure contributes to the solubility of the surface-active agent in the solvent and to the interfacial tension and adhesion tension of the displacement liquid. The concentration of surface-active agent dissolved in the solvent is in the range of about 0.005–1 weight %, based on the weight of the displacement liquid. It is preferred to employ surface-active agents at concentrations of about 0.05–0.5 weight %, especially when it is desirable to minimize residual deposits of the surface-active agent on the material. Occasionally, such residual deposits may be desirable if the surface-active agent imparts a desirable property to the porous material. For example, some such agents may impart corrosion resistance or improved hand or they may also serve as anti-static agents. In such cases, the use of concentrations of surface-active agents greater than 1 weight % may be desirable. Preferred surface-active agents are those which are poorly soluble in water and do not disperse substantial amounts of the displacement liquid in water.

Among known anionic surface-active agents which are suitable for use herein are long chain alkyl carboxylates, alkyl sulfates, alkylaryl sulfonates, amide sulfonates, ester sulfonates, alkyl phosphates and phosphonates and alkyl ether sulfates and phosphates. Some typical but not all inclusive examples of anionic surface-active agents are: (1) the alkylamine salts of the mono- and bis-phosphate esters of fatty alcohols; such salts are of the formula $(RO)_aPO(OH)_{3-a}\cdot(NH_2R'')_{3-a}$ wherein a is 1 or 2, R is $C_{8-14}$ alkyl and R'' is $C_{6-18}$ alkyl, for example, the 2-ethylhexylamine salts of mixed mono(tridecyl) and bis(tridecyl) phosphates; (2) bis-alkyl esters of sulfonated dicarboxylic acids; such esters are of the formula

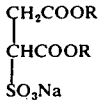

wherein R is $C_{6-12}$ alkyl, for example, the bis(octyl)ester of sodium sulfosuccinic acid; (3) esters of sulfated oleyl alcohol; such esters are of the formula $CH_3(CH_2)_7CH(OSO_3Na)\text{-}(CH_2)_9OOCR'''$ wherein R''' is $C_{1-8}$ alkyl, for example, $CH_3$; and (4) alkyl amine salts of mono- and bis-phosphate esters of alkyl poly(oxyalkylene)alcohols; such salts are of the formula $[RO(CH_2CH_2O)_n]_a\ PO(OH)_{3-a}\cdot(NR_1R_2R_3)_{3-a}$ wherein R is $C_{6-18}$ alkyl, $n$ is 1–4, preferably 2, $a$ is 1 or 2, $R_1$ is H, phenyl or $C_{1-12}$ alkyl and each of $R_2$ and $R_3$ is H or $C_{1-12}$ alkyl, for example, a mixture of $[i\text{-}C_8H_{17}O(CH_2CH_2O)_2]\text{-}PO(OH)_2\cdot(n\text{-}C_8H_{17}NH_2)_2$ and $[i\text{-}C_8H_{17}O(CH_2CH_2O)_2]_2PO(OH)\cdot(n\text{-}C_8H_{17}NH_2)$.

Among known cationic surface-active agents which are suitable for use herein are amines, organic or inorganic acid salts thereof and quaternary ammonium salts having at least one long chain alkyl substituent of 6–20 carbon atoms, preferably 12–18 carbon atoms. The nitrogen atom can be joined directly to the long chain alkyl substituent, for example, as in a long chain alkyl trimethylammonium chloride; it may be separated from the long chain alkyl substituent by an intermediate or linking group, for example, an amide, ester or ether moiety or linking group; or it may be part of a heterocyclic ring to which the long chain alkyl substituent is attached, for example, as in a substituted imidazoline or oxazoline. Some typical but not all inclusive examples of cationic surface-active agents are: cetyltrimethylammonium chloride, dimethyldicocoammonium chloride, cetylpyridinium bromide, the dioleate ester of N,N,N',N'-tetrakis-(2-hydroxypropyl)ethylenediamine quaternized with 0.7–1.7 moles of dimethyl sulfate per mole of ethylenediamine and N-[2-$(C_{17}H_{31-35})$amidoethyl]ethanolamine, the $C_{17}H_{31-35}$ moiety including the saturated alkyl group as well as the unsaturated alkyl groups containing 1 and 2 double bonds. Particularly useful cationic surface-active agents are imidazolines of the formula

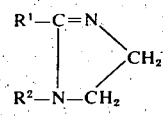

wherein $R^1$ is $C_{10-20}$ alkyl or alkenyl, $R^2$ is $\text{-}(CH_2)_nOH$ or $\text{-}(CH_2)_n\text{-}NHCOR^3$ wherein $n$ is 1–6 and $R^3$ is $C_{10-20}$ alkyl or alkenyl. Preferred surface-active agents include the imidazolines of the above formula wherein $R^1$ is $C_{17}H_{31-35}$ and $R^2$ is $C_{17}\text{-}H_{31-35}CONHCH_2CH_2$ (prepared from tall oil acids and diethylenetriamine) and wherein $R^1$ is $CH_3(CH_2)_7CH{=}CH(CH_2)_7$ and $R_2$ is $HOCH_2CH_2$ (prepared from oleic acid and N-(2-aminoethyl)ethanolamine).

Some of the most useful surface-active agents are those which are derived from a large anion and a large cation, each of which is surface-active, and which are such that it is not possible to state unequivocally that the surface-active agent is anionic or cationic in nature. Such a surface-active agent, a most preferred agent, is the oleic acid salt of 1-(2-hydroxyethyl)-2-$(C_{17}H_{31-35})$-2-imidazoline. Mixtures of anionic and cationic surface-active agents can also be used, for example, a mixture of about equal gram molecular quantities of the cationic surface-active agent formed by quaternization of the dioleate ester of N,N,N',N'-tetrakis(2-hydroxypropyl)-ethylenediamine with 1.7 moles of dimethylsulfate and the anionic surface-active agent formed by neutralization of a mixture of mono- and bis(tridecyl) phosphates with 2-ethylhexylamine.

Among known nonionic surface-active agents, those which are suitable for use herein are predominantly found among such agents which contain blocks of poly(oxyalkylene) units, the alkylene moiety having 2–4 carbon atoms, most commonly 2 or 3 carbon atoms. One such agent which is useful herein can be represented by the formula $H(OCH_2CH_2)_5\text{-}[OCH(CH_3)CH_2]_{30}(OCH_2CH_2)_5\text{-}OH$. A known nonionic surface-active agent which is particularly useful in highly fluorinated solvents, such as perfluorodimethylcyclobutane, is $F[CF(CF_3)CF_2O]_9CF(CF_3)CO(OCH_2CH_2)_6OCH_3$.

Known ampholytic surface-active agents can also be used. An example of such an agent is $F[CF(CF_3)CF_2O]_2CF\text{-}(CF_3)CONH(CH_2)_3N^+(CH_2)_3COO^-$.

Still another consideration in the choice of the displacement liquid relates to the effectiveness of the liquid in solubilizing water. Some surface-active agent-solvent combinations solubilize large amounts of water. For example, the combination of 0.064 weight % of isopropylammonium dodecylbenzenesulfonate in 1,1,2-trichloro-1,2,2-trifluoroethane solubilizes about 3,290 parts per million, by weight, of water. It is preferred to employ combinations which solubilize lesser amounts of water, for example, not more than about 750 parts per million, to avoid depositing the solubilized water on the substrate upon evaporation of the solvent of the displacement liquid. The amount of water solubilized in parts per million by weight is referred to herein as the solubilization index. This parameter, which is described in Belgian 810,949, is measured by titrating distilled water into a 100 ml. sample of displacement liquid until one drop fails to go into clear solution. The mixture is allowed to stand at least one hour, whereupon the solvent layer is analyzed for water by the well known Karl Fischer method. Especially preferred displacement liquids are those having, in addition to an interfacial tension versus water of not more than about 10 dynes $cm.^{-1}$ at 25°C., a positive advancing adhesion tension versus platinum and a density of at least about 1.25 grams $cm.^{-3}$, a solubilization index of not more than about 750 parts per million.

The invention process leaves the porous material substantially free of adsorbed water. The solvent of the displacement liquid is normally recovered. Any suitable recovery process is satisfactory. Since energy conservation, time in process and operating costs are important, particularly in commercial practice, it is preferred to circulate superheated solvent vapor through the material until the material is free of displacement liquid, preferably until the temperature of the material is at least 100°C. The displacement liquid initially forced out by the superheated solvent vapor may normally be reused following filtration and, if necessary, adjustment of surface-active agent concentration. The solvent vaporized from the porous material is condensed, separated from the water by decantation and reconstituted with surface-active agent. Dry steam is preferably used to flush the solvent vapor values from the porous material to a condenser for recovery.

FIG. 1 illustrates a preferred embodiment of the invention process as applied to the continuous treatment of a moving band, such as a textile web, wherein the step of displacement is combined with recovery of the displacement liquid solvent. A moving band 1 passes through entrance slot 2 into water displacement chamber 3. In chamber 3, the band passes under guide rolls 4, thence upwardly between preferably staggered jet spray heads 5 which direct streams of displacement liquid 6 (from storage tank 20 via pump 11 and line 12) against band 1 and through the interstices thereof. Thereafter, the band passes between optional squeeze rolls 7 which reduce the liquid content, typically, in the case of a fluorochlorocarbon liquid, to about 1.6 times the weight of the fabric. The displaced water and the displacement liquid pass by gravity through line 8 into water separator 9 where the water collects as the upper layer 10 which is normally discarded. Dewatered displacement liquid 6 from 9 is returned to storage tank 20 until it is conveyed to jet sprays 5 via pump 11 and line 12. If displacement liquid 6 is to be employed hot, heaters (not shown) can be employed, for example, in line 12. The band, now substantially free of water, passes through slot 13 into solvent evaporation zone housing 14 containing substantially pure vapors of the solvent. Moving band 1 then passes between superheated vapor distributors 15 to evaporate off the solvent of the displacement liquid. Solvent vapors leave housing 14 and pass into condenser 16 at such a rate as to maintain the desired pressure in housing 14. Condensed solvent is stored for reuse (by means not shown). Vapors in housing 14 are taken up by blower 17, forced through superheater 18. where they are heated, and thence to vapor distributors 15. Band 1, now containing in its interstices only solvent in the form of vapor, passes out of housing 14 into steam seal 19. In steam seal 19, the band meets a countercurrent stream of superheated steam which displaces solvent vapor from the interstices of the band and prevents its escape to the atmosphere. Solvent vapor swept from steam seal 19 is recovered by condensation and decantation (by means not shown). The treated band from the exit of steam seal 19 is now dry. The pressure in steam seal 19 is so regulated as to preclude the escape of any substantial amount of solvent vapor. Entrance of steam into evaporation zone housing 14 is normally preferred to loss of solvent vapors. If substantial amounts of steam enter housing 14, thus wetting the solvent stream leaving condenser 16, the two phase condensate can be separated by decantation (by means not shown). Means (not shown) are employed to provide solvent to superheater 18 for start up. Preferably but not shown, a steam seal, similar to 19, or a water seal, comprising a means of dipping the band below a water layer, so arranged as to close entrance slot 2 to gas passage, is employed. Similarly, a solvent vapor seal comprising squeeze rolls (not shown) to prevent gas passage through slot 13 may be employed.

Figure 2:
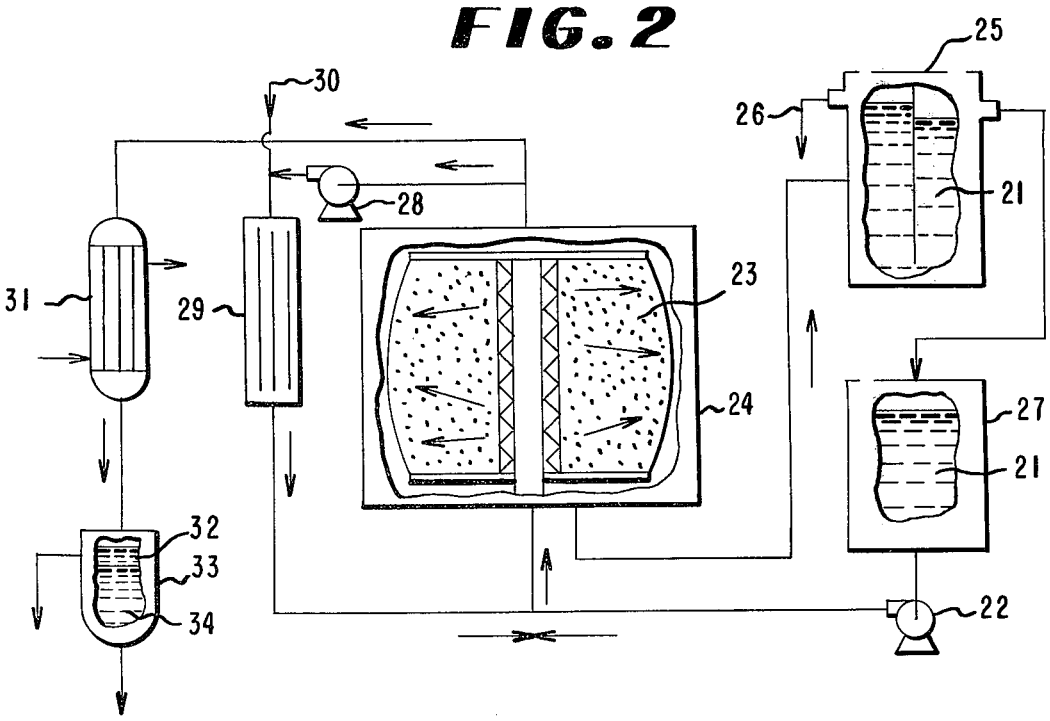
FIG. 2 illustrates a batch process embodiment for displacing water from a yarn package.

FIG. 2 illustrates a batch process embodiment for displacing water from a yarn package. In this embodiment, the steps of displacement of water, evaporation of solvent by means of superheated vapor and displacement of vapor by means of superheated steam take place stepwise. In the first step, displacement liquid 21 is pumped by means of pump 22 to the core of yarn package 23. The displacement liquid passes outwardly through the package displacing water from interstices therein. The mixture of displacement liquid and water passes into housing 24 and from there flows into water separator 25 wherein the water is separated and normally discarded through line 26. Displacement liquid 21 is returned for reuse to storage tank 27. In the second step, superheated solvent vapors are pumped though the yarn package. The vapors pass through the package, converting liquid solvent therein to vapor. Vapors pass out of housing 24 to pump 28 which forces them to the yarn package core via superheater 29 wherein they are heated. A small amount of solvent is introduced (by means not shown) at line 30 at the beginning of the evaporation step to provide vapor for start up. An amount of vapor corresponding approximately to the amount evaporated in the yarn package is removed through condenser 31. In the third step, when substantially all the solvent in package 23 is evaporated, dry steam is introduced (by means not shown) at line 30. After passing (optionally) through superheater 29, the dry steam is passed through package 23, displacing vapor therefrom and from housing 24. The dry steam should be at a temperature such that there is no substantial condensation thereof on the yarn. Steam and vapors pass through condenser 31 wherein they are condensed. Displaced water 32 collects as the upper layer in separator 33 and is normally discarded. Solvent 34 is collected for reuse (by means not shown).

Although it is not preferred, displacement liquid, superheated vapor and steam may be circulated in the other direction through the package, that is, from the outside to the inside. By obvious modifications, a plurality of packages can be dried at the same time.

The following examples include demonstrations of the use of displacement liquids which are either within or outside the definition provided above. Various devices were employed to force the displacement liquid through the interstices of the porous materials. For example, displacement liquids were forced impulsively through various kinds of yarn packages contained in a yarn package dyeing device. Examples employing this device are hereinafter referred to as examples of process A. In a variation of process A, hereinafter designated as examples of process B, water-wet yarn tow and nonwoven mats were contacted pulsewise by diverting displacement liquid from a closed loop to a loop comprising a container packed more or less tightly with the tow or mats. In a further example, hereinafter designated process C, water was displaced from a nylon carpet by applying an open pipe directly to the carpeting and thereafter directing displacement liquid through the pipe into contact with the carpeting pulsewise. After contacting the fibrous substrates with displacement liquid, the residual water remaining on and in the fibers was measured by methanol extraction of the fibers followed by determination of the water extracted by the methanol. In carrying out the water determination, the fibrous sample of known weight, wet with displacement liquid, was quickly transferred to a tared closed container containing absolute methanol and retained therein for 24 hours with occasional stirring. Aliquot samples were removed and analyzed for water by the well known method of Karl Fischer. Weight percent residual water in the sample was calculated on the basis of dry sample, that is, after correcting for the weight of displacement liquid in the sample.

EXAMPLES 1–28

Table 3 includes examples which demonstrate that suface-active agent-solvent combinations falling within the invention criteria of interfacial tension, adhesion tension and density displace water from the fibrous materials shown in the table to a degree comparable to the regain values at 100% relative humidity shown in Table 1. Displacement liquids of Examples 11, 12, 13, 14, 16, 17, 22, 23, 26, 27 and 28 fall outside invention criteria and generally leave amounts of water greatly exceeding 100% relative humidity water regain values. It is believed that the displacement liquid of Example 17, although falling outside the invention criteria, reduced the residual water level to a low value because the high degree of compaction had forced much of the water from the yarn package. Table 4 shows the composition and type of the surface-active agents employed in the 28 examples.

Table 3

| Ex. No. | Process | Solvent | Surfactant No. | Surfactant Conc. (Wt. %) | Interfacial Tension (dynes cm.$^{-1}$) | Adhesion Tension (Sign) | Density (g.cm.$^{-1}$) (25°C.) | Water Solubilization Index (ppm., wt.) | $H_2O$ Displacement From | Vol. Flux (cm. sec.$^{-1}$) | Residual $H_2O$ (Wt. %) |
|---|---|---|---|---|---|---|---|---|---|---|---|
| 1 | B | $CCl_2FCClF_2$ | 1 | 0.064 | 2 | + | 1.57 | 507 | polyester mat[3] | — | 0.46 |
| 2 | A | $CCl_2FCClF_2$ | 1 | 0.064 | 2 | + | 1.57 | 507 | polyester yarn pkg.[2] | 7 | 0.9 |
| 3 | A | $CCl_2FCClF_2$ | 1 | 0.064 | 2 | + | 1.57 | 507 | polyester yarn pkg.[2] | 5 | 1.0 |
| 4 | A | $CCl_2FCClF_2$ | 1 | 0.064 | 2 | + | 1.57 | 507 | nylon 66 yarn pkg.[1] | 10 | 11.0 |
| 5 | A | $CCl_2FCClF_2$ | 1 | 0.064 | 2 | + | 1.57 | 507 | polyacrylonitrile pkg.[1] | 10 | 8.0 |
| 6(a) | C | $CCl_2FCClF_2$ | 1 | 0.064 | 2 | + | 1.57 | 507 | nylon carpet[3] | 10 | 5.8 |
| (b) | C | $CCl_2FCClF_2$ | 1 | 0.064 | 2 | + | 1.57 | 507 | nylon carpet[3] | 1 | 18 |
| 7 | A | $CCl_2FCClF_2$ | 1 | 0.064 | 2 | + | 1.57 | 507 | mercerized cotton pkg.[1] | 10 | 52.9 |
| 8 | A | $CCl_2FCClF_2$ | 1 | 0.064 | 2 | + | 1.57 | 507 | mercerized cotton pkg.[1][3] | 10 | 28.7 |
| 9 | A | $CCl_2FCClF_2$ | 1 | 0.064 | 2 | + | 1.57 | 507 | mercerized cotton pkg.[1] | 10 | 33.8 |
| 10 | B | $CCl_2FCClF_2$ | 7 | 0.318 | 9 | + | 1.57 | 89 | polyester mat[3] | 13 | 12.0 |
| 11 | B | $CCl_2FCClF_2$ | 7 | 0.064 | 11 | + | 1.57 | — | polyester mat[3] | — | 18.0 |
| 12 | B | $CCl_2FCClF_2$ | 7 | 0.006 | 12 | + | 1.57 | — | polyester mat[3] | — | 29.0 |
| 13 | B | $CCl_2FCClF_2$ | 8 | 0.064 | 5 | − | 1.57 | 107 | polyester mat[3] | 11 | 27.2 |
| 14 | B | $CCl_2FCClF_2$ | 9 | 0.064 | 8 | − | 1.57 | 61 | polyester mat[3] | 11 | 15 |
| 15 | B | $CCl_2FCClF_2$ | 11 | 0.064 | 3 | + | 1.57 | — | polyester mat[3] | 11 | 5.0 |
| 16 | B | $CCl_2FCClF_2$ | None | — | 46 | + | 1.57 | — | polyester mat[3] | 11 | 43 |
| 17 | B | $CCl_2FCClF_2$ | None | — | 46 | + | 1.57 | — | polyester yarn pkg.[3][1] | 11 | 6 |
| 18 | A | $CCl_2FCClF_2$ | 1 and 6 | 0.064 0.054 | — | + | 1.57 | — | polyacrylonitrile tow[3] | — | 6.2 |
| 19 | A | $CCl_3F$ | 5 | 0.067 | — | − | 1.49 | — | polyester mat[3] | 11 | 5.1 |
| 20 | A | $CCl_3CH_3$ | 2 | 0.029 | 3 | + | 1.34 | — | polyester mat[3] | 11 | 0.9 |
| 21 | A | $CCl_3CH_3$ | 13 | 0.037 | 3 | + | 1.34 | — | polyester mat[3] | 11 | 0.3 |
| 22 | A | $CCl_3CH_3$ | 14 | 0.149 | 17 | − | 1.34 | — | polyester mat[3] | 11 | 31 |
| 23 | A | $CCl_3CH_3$ | None | — | 26 | − | 1.34 | — | polyester mat[3] | 11 | 27 |
| 24 | A | $CCl_2{=}CHCl$ | 3 | 0.171 | 1 | + | 1.46 | — | polyester mat[3] | 11 | 0.6 |
| 25 | A | $CCl_2{=}CCl_2$ | 4 | 0.184 | — | − | 1.63 | — | polyester mat[3] | 11 | 0.8 |
| 26 | A | $CCl_2{=}CCl_2$ | 10 | 0.061 | 29 | + | 1.63 | — | polyester mat[3] | 11 | 39 |
| 27 | A | $CCl_2{=}CCl_2$ | 12 | 0.061 | 16 | + | 1.63 | — | polyester mat[3] | 11 | 36 |
| 28 | A | $CCl_2{=}CCl_2$ | None | — | 44 | + | 1.63 | — | polyester mat[3] | 11 | 41 |

[1]compacted 30–40%; i.e. to 70–60% of package length
[2]not compacted
[3]pulsed flow Table 4

| No. | Type* | Surface-Active Agents Chemical Composition |
|---|---|---|
| 1 | A-C | 1-(2-hydroxyethyl)-2-($C_{17}H_{31-35}$)-2-imidazoline oleate |
| 2 | A | $CH_3(CH_2)_7CH(OSO_3Na)(CH_2)_9OOCCH_3$ |
| 3 | C | Cetyl Pyridinium Bromide |
| 4 | A | Sodium Alkylnaphthalene Sulfonate |
| 5 | C | $C_{17}H_{31-35}NHCH_2CH_2NH_3^+C_{17}H_{35}COO^-$ |
| 6 | C | N,N,N',N'-tetrakis-(2-hydroxypropyl)ethylenediamine, dioleated |

Table 4-continued

| No. | Type* | Surface-Active Agents Chemical Composition |
|---|---|---|
| | | and quaternized with 0.7–1.7 moles dimethylsulfate per mole ethylenediamine |
| 7 | A | Mixed mono-(tridecyl) and bis-(tridecyl) phosphates neutralized with 2-ethylhexylamine |
| 8 | N | $C_{18}H_{35}(OCH_2CH_2)_{1.5}OH$ |
| 9 | N | $H(OCH_2CH_2)_{2.2}(OCH(CH_3)CH_2)_{30.1}(OCH_2CH_2)_{2.2}OH$ |
| 10 | C | 2-$(C_{11}H_{23})$oxazole |
| 11 | C | $(C_{18}H_{37})_{0.93}(C_{16}H_{33})_{0.08}(C_{18}H_{35})_{0.01}NH_2$ |
| 12 | C | Polypropoxylated Quaternary Ammonium Chloride |
| 13 | A | Bis(tridecyl)ester of Sodium Sulfosuccinic Acid |
| 14 | N | $H[OCH(CH_3)CH_2]_{15.1}(OCH_2CH_2)_{4.4}[OCH(CH_3)CH_2]_{15.1}OH$ |

*A = anionic
C = cationic
N = nonionic
A-C = large anion + large cation

EXAMPLE 29

This example demonstrates the invention process as it might be applied to the rapid drying of unworn wigs comprising human or artificial hair. A 2-gram swatch of hair was wetted with water, reweighed and hung in a closed chamber fitted with a 30° jet sprayhead and drain. During 60 seconds, 2.8 liters of a 0.160 wt. % solution of surface-active agent No. 1 of Table 4 in 1,1,2-trichloro-1,2,2-trifluoroethane were sprayed onto and through the swatch. Displaced water was collected and measured, from which it was calculated that 71% by weight of the original water was displaced.

The experiment was repeated using pure 1,1,2-trichloro-1,2,2-trifluoroethane, with the result that only 57% of the water was displaced.

EXAMPLE 30

This example demonstrates the continuous drying of open-width, polyethylene terephthalate double-knit fabric by the invention process wherein the fabric was immersed in displacement liquid and the liquid was forced through the interstices by means of jet sprays disposed under the liquid surface. A 2-inch (5.1 cm.) wide band of fabric wetted with tinted water was passed under the surface of a displacement liquid at 2 yds. (1.52 meters) per minute, 0.5 inch (1.3 cm.) above five successive spray tubes at right angles to the direction of travel, each tube having sixteen 0.02 inch (0.05 cm.) diameter holes directing jets of displacement liquid at the underside of the fabric at a velocity such that at last a part of the displacement liquid passed through the interstices of the fabric. Vertical walls above the fabric and defining four compartments along the immersed length of the fabric served to confine the displaced water and drain it away through drains in each compartment so that the substantially water-free fabric could be brought upwardly out of the displacement liquid at the end of the run without passing through a water layer. The bulk of the water was seen to be displaced. By water analysis of the fabric as described in connection with Examples 1–28, it was shown that the water content of the fabric, originally 55 wt. %, was reduced to 1.5 wt. %.

EXAMPLE 31

Displacement liquid (0.35 wt. % of surface-active agent No. 7 of Table 4 in 1,1,2-trichloro-1,2,2-trifluoroethane solvent) was forcibly passed through a 6.25 × 7.5 cm. lead-lead oxide battery electrode (dry weight 105.6 g.) containing 8.0 g. of water. The forcible flow was caused by applying a vacuum to the top side of the electrode, sealed by pressure against a lip on an appropriately shaped vessel which was connected to a liquid receiver and thence to the vacuum line, the bottom side of the electrode being immersed in displacement liquid. After 2.2 minutes, 1,610 ml. of the displacement liquid had passed through the electrode. Pure solvent (500 ml.) was passed through the electrode by this same means to accomplish rinsing. The residual water, determined as described previously, was found to be 0.66 g. (92% water removed).

In a similar manner, another electrode was dried with a displacement liquid comprising 0.07 wt. % of surface-active agent No. 1 of Table 4 in 1,1,2-trichloro-1,2,2-trifluoroethane. Residual water was 0.28 g. (97% removed). By comparison, when another electrode was immersed flat in a boiling bath of this same displacement liquid for 5 minutes and rinsed by immersion in boiling solvent for 30 seconds, the residual water was 7.1 g. (11% water removed). The necessity for forcible passage through the interstices to achieve good water removal is thus illustrated.

EXAMPLE 32

This example demonstrates the removal of water from a package of yarn using a displacement liquid followed by removal from the yarn package, first, of at least some of the displacement liquid and, thereafter, of the remaining displacement liquid solvent. Superheated vapor of the displacement liquid solvent is employed to effect the removal of displacement liquid and displacement liquid solvent, it being understood that displacement liquid solvent removal by ebullition, when the yarn package temperature reaches the boiling point of the solvent, may lead to deposition of such amount of surface-active agent as is present in the volume of displacement liquid remaining in the yarn package.

A 387 g. package of polyester textured filament yarn, 150 denier, wound on a spring core, was placed between flat end-plates on a perforated spindle, compressed to 60% of its original length, and mounted in a housing in a manner such as shown in FIG. 2. Water was forced through the package in an inside-to-outside direction for about five minutes to simulate the rinsing process which may be employed in a commercial aqueous disperse dyeing process. The yarn package was thus completely saturated with water. The supply line was drained of water and filled with displacement liquid consisting of a solution of 0.75 g./liter of a surface-active agent (of the same type as No. 1 of Table 4) in 1,1,2trichloro-1,2,2-trifluoroethane. This displacement liquid had an interfacial tension of 4.5 dynes/cm., a positive adhesion tension versus platinum and a density of about 1.56 g./cm.$^3$ at 25°C. The supply line of displacement liquid was connected to a supply tank of the displacement liquid located about 120 feet (36.6 meters) above the package drying apparatus (to achieve gravity flow). Flow of displacement liquid to the package was controlled by a solenoid-operated valve. The displacement liquid was forced pulsewise through the yarn package by opening the valve for 0.5 second. This was repeated two times. The flow of displacement liquid through the package during each of the 3 pulses was about 1.0 liter. The mixture of displacement liquid and water passed to a water separator, from which the separated displacement liquid was returned to a storage tank; the water was discarded. Immediately following the third pulse of displacement liquid the supply line was drained of liquid and vapor of 1,1,2-trichloro-1,2,2-trifluoroethane, superheated to about 160°C., was passed through the package in an inside-to-outside direction. Following an initial flow (about 10 second duration) of liquid forced from the interstices of the package, the package temperature, as measured by a thermocouple located next to the outside of the package, rose to 45°–7°C.; the boiling temperature of the solvent is 48°C. After 2 minutes the temperature began to rise again and reached 110°C. in 2 additional minutes. Displacement liquid solvent vaporized from the yarn package and the superheated solvent vapor which was being passed through it were recovered by condensation and returned to the solvent storage vessel. The yarn package was removed and its water content was determined as previously described (extraction with dry methanol and Karl Fischer analysis). The water content of the dried package was only 0.13% by weight. In contrast to conventional thermal evaporative drying procedures which require 1–3 hours to achieve this water level, this invention process required less than 5 minutes of total operating time.

I claim:

1. Process for drying water-wet porous materials, which process comprises forcing a displacement liquid through the open interstices of the water-wet porous material to remove the water, the displacement liquid consisting of a water-immiscible, normally liquid organic solvent having a surface-active agent dissolved therein, said displacement liquid having at 25°C. an interfacial tension versus water of no greater than about 10 dynes cm$^{-1}$ at 25°C., a density of at least about 1.25 grams cm.$^{-3}$ and an advancing adhesion tension versus platinum which is positive, and recovering porous material whose open interstices are substantially free of liquid water.

2. Process of claim 1 wherein the displacement liquid is forced through the open interstices at a flux of at least 0.1 cm. sec.$^{-1}$.

3. Process of claim 2 wherein the flux is at least 1 cm. sec.$^{-1}$.

4. Process of claim 1 wherein the displacement liquid is forced through the porous material pulsewise.

5. Process of claim 1 wherein the interfacial tension of the displacement liquid is no greater than about 3 dynes cm.$^{-1}$.

6. Process of claim 1 wherein the displacement liquid has a water solubilization index of not more than about 750 ppm.

7. Process of claim 5 wherein the displacement liquid has a water solubilization index of not more than about 750 ppm.

8. Process of claim 1 wherein the normally liquid organic solvent is a fluorine-containing compound having a boiling point no greater than about 150°C.

9. Process of claim 8 wherein the solvent is trichlorofluoromethane or 1,1,2-trichloro-1,2,2-trifluoroethane.

10. Process of claim 1 wherein the concentration of surface-active agent dissolved in the organic solvent is 0.005–1 weight %, based on the weight of displacement liquid.

11. Process of claim 10 wherein the surface-active agent is anionic.

12. Process of claim 10 wherein the surface-active agent is cationic.

13. Process of claim 10 wherein the surface-active agent is nonionic.

14. Process of claim 10 wherein the surface-active agent is a mixture of cationic and anionic surface-active agents or is derived from a large cation and a large anion, each of which is surface-active.

15. Process of claim 10 wherein the concentration of surface-active agent is 0.05–0.5 weight %.

16. Process of claim 1 wherein the porous substrate is a textile.

17. Process of claim 16 wherein the textile is yarn.

18. Process of claim 16 wherein the textile is carpet.

19. Process of claim 1 carried out continuously.

20. Process of claim 1 carried out batchwise.

21. Process of claim 1 wherein the porous material whose open interstices are substantially free of liquid water is contacted with superheated vapor of the organic solvent to remove displacement liquid and substantially all of the liquid phase organic solvent.

22. Process of claim 21 wherein the porous material, after removal of substantially all of the liquid phase organic solvent, is contacted with dry steam at a temperature sufficient to avoid substantial condensation thereof on the material to displace organic solvent vapor from the material.

23. Process of claim 22 wherein the organic solvent is trichlorofluoromethane or 1,1,2-trichloro-1,2,2-trifluoroethane and the surface-active agent is a mixture of cationic and anionic surface-active agents or is derived from a large cation and a large anion, each of which is surface-active.

24. Process of claim 23 wherein the porous material is a textile.

* * * * *